US007458485B2

(12) United States Patent
Amron

(10) Patent No.: US 7,458,485 B2
(45) Date of Patent: Dec. 2, 2008

(54) WATER GUN AMUSEMENT DEVICES AND METHODS OF USING THE SAME

(75) Inventor: Alan Amron, Brooklyn, NY (US)

(73) Assignee: Tropical Ventures LLC, Hemstead, NY (US)

( * ) Notice: Subject to any disclaimer, the term of this patent is extended or adjusted under 35 U.S.C. 154(b) by 163 days.

(21) Appl. No.: 11/136,693

(22) Filed: May 23, 2005

(65) Prior Publication Data

US 2006/0261087 A1 Nov. 23, 2006

(51) Int. Cl.
*A63H 3/18* (2006.01)

(52) U.S. Cl. ..... 222/79; 239/222.11; 239/222.15; 239/264

(58) Field of Classification Search ..... 222/79; 239/263, 264, 227, 525, 39, 222.11, 222.15, 239/380, 381
See application file for complete search history.

(56) References Cited

U.S. PATENT DOCUMENTS

| | | | | | |
|---|---|---|---|---|---|
| 1,150,940 | A | | 8/1915 | Irish | |
| 1,941,786 | A | | 1/1934 | Carley et al. | |
| 2,830,739 | A | | 4/1958 | Moye | |
| 2,998,166 | A | | 8/1961 | Klawiter | |
| 3,399,638 | A | | 9/1968 | Bishop et al. | |
| 3,493,179 | A | | 2/1970 | Lee | |
| 3,804,336 | A | | 4/1974 | Koeppe | |
| 4,335,677 | A | | 6/1982 | Nagata | |
| 4,397,879 | A | | 8/1983 | Wilson | |
| 4,542,853 | A | | 9/1985 | Diamond | |
| 4,615,488 | A | * | 10/1986 | Sands | 239/391 |
| 4,709,691 | A | | 12/1987 | Lemons et al. | |
| 4,821,961 | A | * | 4/1989 | Shook | 239/253 |
| 4,842,200 | A | * | 6/1989 | Hermansson | 239/263 |
| 4,989,786 | A | * | 2/1991 | Kranzle et al. | 239/240 |
| 5,024,382 | A | * | 6/1991 | Shook et al. | 239/11 |
| 5,060,863 | A | * | 10/1991 | Hammelmann | 239/252 |
| 5,086,974 | A | * | 2/1992 | Henshaw | 239/101 |
| 5,104,043 | A | * | 4/1992 | Pacht | 239/128 |
| 5,244,153 | A | * | 9/1993 | Kuhn et al. | 239/587.5 |
| 5,297,979 | A | | 3/1994 | Amron | |
| 5,392,968 | A | | 2/1995 | Dark | |
| 5,427,320 | A | * | 6/1995 | Mak et al. | 239/587.5 |
| 5,456,413 | A | * | 10/1995 | Ellis | 239/259 |
| 5,582,532 | A | | 12/1996 | Tucker | |
| 5,586,688 | A | | 12/1996 | Johnson et al. | |

(Continued)

*Primary Examiner*—Len Tran
*Assistant Examiner*—Trevor E. McGraw
(74) *Attorney, Agent, or Firm*—Cohen Pontani Lieberman & Pavane LLP

(57) ABSTRACT

Toy water guns include a housing supporting a liquid storage chamber, a conduit for establishing fluid communication between the chamber and a discharge orifice disposed proximate a front end of the housing, a trigger mechanism, a fluid transfer system adapted to develop forces for causing a continuous or pulsed stream of liquid to flow through the conduit and out of the discharge orifice when the trigger is pressed. A first embodiment employs a rotatable nozzle assembly that is dimensioned and arranged to spin as it receives a stream of liquid via the conduit. The nozzle assembly ejects a stream of liquid as it spins to thereby obtain a helical "tornado" flow pattern. In a second embodiment, a fixed or movable deflector is used so that water exiting a nozzle strikes a surface of the deflector to thereby develop a "wave" or "hard rain" discharge pattern. Multiple modes of operation are also contemplated.

18 Claims, 6 Drawing Sheets

U.S. PATENT DOCUMENTS

| | | | | |
|---|---|---|---|---|
| 5,667,138 | A | 9/1997 | Crampton | |
| 6,007,003 | A * | 12/1999 | Wang | 239/525 |
| 6,129,293 | A | 10/2000 | Jaeger | |
| 6,155,494 | A | 12/2000 | Fabbri et al. | |
| 6,186,367 | B1 | 2/2001 | Harrold | |
| 6,196,475 | B1 | 3/2001 | Jaeger | |
| 6,199,771 | B1 | 3/2001 | Clearman et al. | |
| 6,250,506 | B1 | 6/2001 | Geiger et al. | |
| 6,422,480 | B1 | 7/2002 | Richmond | |
| 6,594,843 | B1 * | 7/2003 | Wilkins | 15/24 |
| 6,719,218 | B2 * | 4/2004 | Cool et al. | 239/443 |
| 6,766,967 | B2 | 7/2004 | Harris et al. | |
| 6,899,286 | B2 | 5/2005 | Blessing | |
| 6,935,531 | B1 * | 8/2005 | Clayton | 222/79 |
| 6,959,838 | B2 * | 11/2005 | Eddins et al. | 222/79 |
| 7,032,837 | B2 | 4/2006 | Eddins et al. | |
| 7,097,073 | B2 * | 8/2006 | Zimmerman | 222/79 |
| 7,131,557 | B2 * | 11/2006 | Zimmerman et al. | 222/79 |
| 7,182,477 | B1 | 2/2007 | Hartz | |
| 7,185,787 | B2 * | 3/2007 | Brown et al. | 222/79 |
| 2001/0019083 | A1 | 9/2001 | Marks | |
| 2002/0030066 | A1 | 3/2002 | McKenna | |
| 2003/0071141 | A1 | 4/2003 | Rieben | |
| 2003/0085303 | A1 | 5/2003 | Jaeger | |
| 2004/0164090 | A1 * | 8/2004 | Eddins et al. | 222/39 |
| 2005/0035148 | A1 | 2/2005 | Zimmerman | |
| 2005/0173559 | A1 | 8/2005 | Eddins et al. | |

* cited by examiner

WATER GUN AMUSEMENT DEVICES AND METHODS OF USING THE SAME

FIELD OF THE INVENTION

The present invention relates generally to toy water guns and, more particularly, to toy water guns operative, in accordance with at least one mode of operation, to discharge water in a configuration other than as a fixed, extended stream.

BACKGROUND OF THE INVENTION

Water guns have for decades been a very popular child's toy. The toy industry is very competitive, hundreds of different style water guns have been developed in an attempt to profit from the toy's inherent popularity. The earliest forms of water guns were activated by the pumping action which occurs during the depression of a trigger. Accordingly, the range and volume of water expelled by these water pistols was limited by the throw of the trigger. With the goal of projecting more water faster on the target always in mind, toy water gun designers have introduced a number of significant design enhancements—with many of these enjoying a substantial degree of commercial success.

Pressure differential water guns employing a bladder are exemplified by U.S. Pat. No. 4,854,480 to Robert S. Shindo and U.S. Pat. No. 4,735,239 to Michael E. Salmon et al, which show toy water devices that use an elastic bladder to pressurize water. The bladders are filled with high pressure water, and the bladders respond by elastically deforming. The source of pressurized water is then removed and the water within the expanded bladder is held in place by a clamping device activated by a trigger. The water gun is used by selectively releasing the clamp, allowing the water to flow from the expanded bladder. For so long as water remains in the bladder and the trigger is depressed, water is ejected through the nozzle in an extended, continuous stream for so long as the trigger is depressed.

Since a source of pressurized water is not always available, a number of other methods have been devised to enhance the flow rate and range of streams ejected by toy water guns. In U.S. Pat. No. 4,022,350 entitled WATER GUN and issued to the inventor herein, Alan Amron, on May 20, 1977, there is disclosed a toy water gun that incorporates a battery driven motor and associated pump. By means of reciprocating movement of the pump piston, water is drawn from a reservoir and discharged through a nozzle. The discharge is interrupted by the intake strokes of the piston so that the discharge is accomplished intermittently or in spurts rather than in a continuous stream.

Water guns have also been developed that use air pressure to pressurize water in a reservoir and to force the water through an avenue of release extending from the reservoir to a discharge nozzle. Such toys that use air pumps to pressurize water are exemplified by U.S. Pat. No. 3,163,330 issued to J. W. Ryan on Dec. 29, 1964 and entitled TOY WATER SHOOTING CAP RIFLE, which shows a toy rifle consisting of a pressurized water reservoir, a pump for manually pressurizing the water reservoir, and a valve activated by a trigger to allow the pressurized water to flow toward the nozzle. The water is discharged as a continuous extended stream for as long as the trigger is depressed provided that sufficient air remains in the reservoir to keep the water flowing.

In the past decade, pressurized water guns equipped with a hand operated pump, as taught by Ryan, have enjoyed a considerable degree of commercial success. However, the need to repeatedly operate the pumping mechanism—often twenty five times or more—to achieve adequate air pressurization within the reservoir, has presented a challenge to the impatient user and to smaller children. For this reason, it has been proposed in U.S. Pat. No. 6,234,347 entitled PRESSURIZED WATER GUN WITH SELECTIVE PRESSURIZATION and issued to the inventor herein on May 22, 2001, to give the user an option of selecting one of two different modes of pressurization—manual pressurization using an onboard pump or, when a source of municipally pressurized water is accessible, a one-way valve system designed to admit the already-pressurized water into the reservoir. Regardless of the method used for pressurizing the Amron water gun, depression of the trigger causes water to flow from the reservoir, through an avenue of release, and out the ejection nozzle as a continuous, extended stream.

The development and introduction of various design features over the past six decades have unquestionably yielded toy water guns which have better performance and operating characteristics (e.g., faster flow rates and the ability to discharge streams over longer distances) than the traditional water pistol design. Notably, however, the actual configuration of the toy water gun "output" has remained substantially the same during all that time. That is, while their range and flow rates have increased, toy water guns have heretofore been designed to produce a concentrated, straight stream of water capable, for example, of being aimed at and of striking a discrete point—usually in the shortest distance possible. A need therefore exists for toy water guns capable of discharging water in more innovative and creative ways.

SUMMARY OF THE INVENTION

The aforementioned need is addressed, and an advance is made in the art, by toy water gun devices in which the water need not be directed at a target as a linear, extended stream (whether continuous or pulsed), though such operation—as an optional alternative mode—is not necessarily excluded.

A water gun constructed in accordance with a first illustrative embodiment of the present invention comprises a housing and an extended handle connected to the housing. A barrel portion of the housing defines a longitudinal axis extends outwardly away from the handle. The water gun further comprises a nozzle assembly defining a discharge outlet, the nozzle assembly being adapted to rotate relative to the barrel portion about an axis of rotation. An avenue of release connects the nozzle assembly to the water storage reservoir, and a trigger is located on the housing adjacent the handle. The nozzle assembly is dimensioned and arranged to rotate so that while the trigger is depressed, the stream of water being discharged through the outlet traverses an arcuate path relative to the longitudinal axis of the barrel portion while the barrel portion remains stationary. The stream discharged has a helical configuration, which is unbroken for so long as the trigger is depressed and water is flowing through the avenue of release.

Automatic rotation of the nozzle assembly to produce a helical discharge effect can be achieved in a variety of ways. An illustrative nozzle assembly constructed in accordance with this embodiment of the invention includes a motorized drive assembly responsive to depression of the trigger or, alternatively, to actuation of an on/off selector switch, and drivingly engageable with appropriate gearing on the nozzle assembly. Instead of a motor, the force for spinning the nozzle assembly may be provided via the pressurized water stream traversing the avenue of release. For example, a water turbine assembly can be placed at an appropriate location in the flow path. By way of yet another example, the discharge outlet of the nozzle assembly may be dimensioned and arranged to impart a nozzle reaction force—that is offset relative to the axis of nozzle assembly rotation—as the stream of water is discharged. Even a relatively small angle of inclination of the discharge stream relative to a plane orthogonal to the rotational axis of the nozzle assembly is sufficient to induce rotation of the nozzle assembly.

In accordance with another embodiment of the invention, a wave-like discharge of water is obtained. A water gun constructed in accordance with this embodiment of the present invention comprises a housing and an extended handle connected to the housing. A barrel portion of the housing defines a longitudinal axis extends outwardly away from the handle. The water gun further comprises a nozzle assembly defining a discharge outlet dimensioned and arranged to eject a continuous stream and/or brief but high volume pulses so that these strike a deflector assembly. An avenue of release connects the nozzle assembly to the water storage reservoir, and a trigger is located on the housing adjacent the handle. While the trigger is depressed, the water discharged through the discharge outlet strikes the deflector structure at an angle selected to produce a divergent, flattened output resembling a wave. This effect is especially pronounced when short, high volume pulses are "bounced" off the deflector.

In yet another embodiment of the invention, water is ejected in a manner that simulates a torrent of rain. To this end, the water gun includes a trigger, a latching mechanism, and a spring loaded, pivoting catapult lever defining a receptacle that is dimensioned and arranged to receive a charge of water and to hurl this charge of water at a target when the trigger is depressed and the latching mechanism is released. A water gun constructed in accordance with this illustrative embodiment further comprises a housing and an extended handle connected to the housing. A barrel portion of the housing defines a longitudinal axis extends outwardly away from the handle. The spring-loaded, pivoting receptacle is positioned within the barrel portion of the housing and is charged with water while in an initial position. When released by the latching mechanism, the receptacle pivots about an axis transverse to the longitudinal axis of the barrel and the charge of water is released once the catapult lever reaches a certain point in its arcuate travel. A cover assembly utilizing a spring actuated linkage or other suitable mechanism can be included so that the water can not escape from the receptacle during pivoting of the catapult lever. Alternatively, a torrent of rain may be achieved using a deflector assembly.

BRIEF DESCRIPTION OF THE DRAWINGS

The details of the present invention, both as to its construction and operation can best be understood with reference to the accompanying drawings, in which like numerals refer to like parts, and in which.

DETAILED DESCRIPTION OF THE INVENTION

Figure 1:
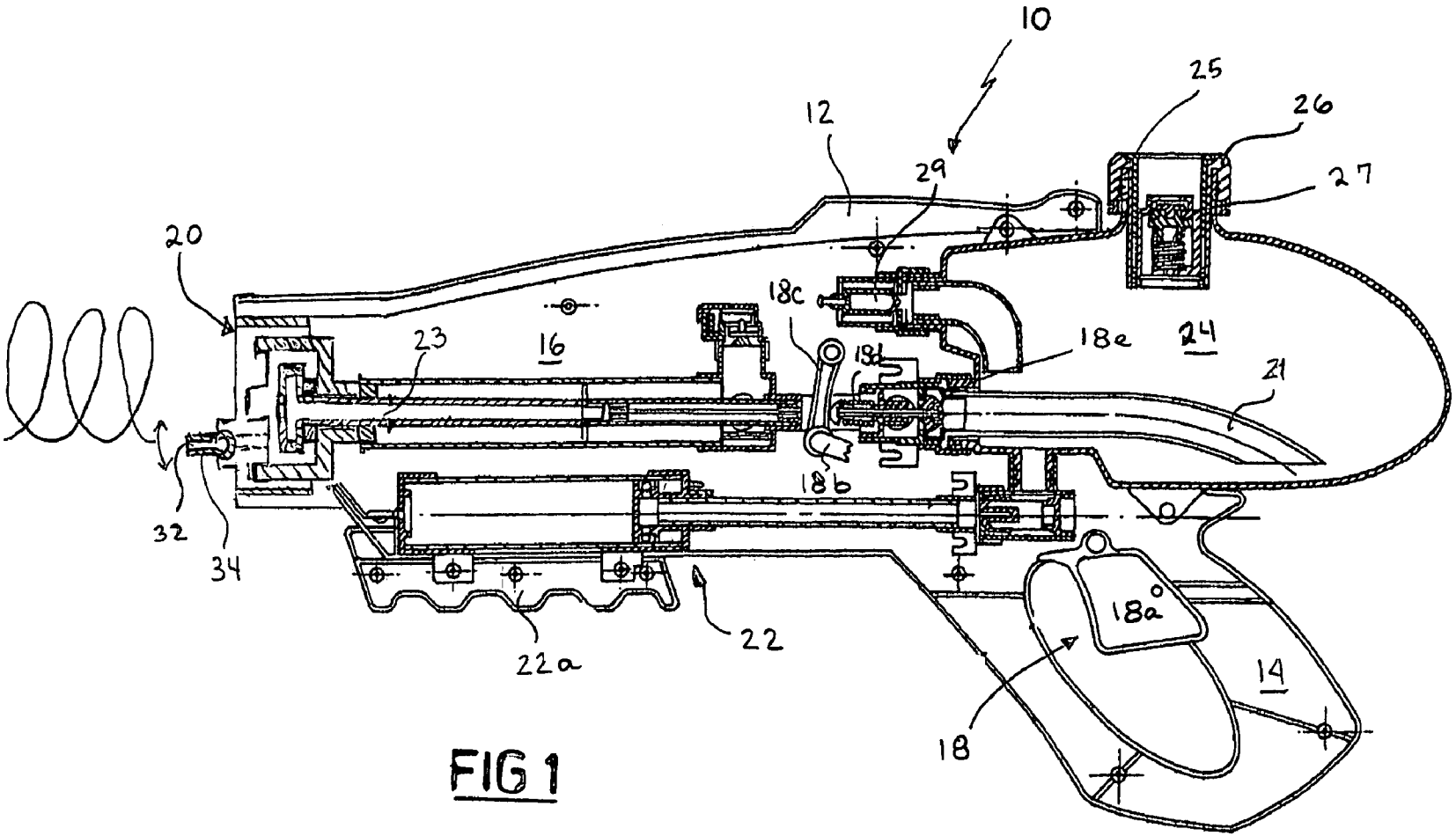
FIG. 1 is a side elevation view, in cross section, depicting a water gun constructed in accordance with a first illustrative embodiment of the present invention, the water gun being equipped with a nozzle assembly adapted to rotate automatically, as water is discharged, to produce a continuous or interrupted helical stream.

The accompanying Figures and this description depict and describe embodiments of a water gun amusement device in accordance with the present invention, and features and components thereof. The present invention also encompasses a method of making and using embodiments of the amusement device. As used herein, the phrases or terms "water gun amusement device," "toy gun," "water gun," "squirt gun" and the like are intended to encompass a structure or structures configured to project, throw, squirt, launch or shoot a generally liquid material, such as water or the like, in a manner other than as a continuous stream or a broken stream of repeated, single "shots," bursts, doses or quantities of water or the like. It is important to note, however, that toy water guns constructed in accordance with the present invention can, if an optional mode of operation is desired, be configured to project a continuous or broken stream if the user so selects. It should also be noted that any references herein to front and back, right and left, top and bottom and upper and lower are intended for convenience of description, not to limit the present invention or its components to any one positional or spacial orientation.

With regard to fastening, mounting, attaching or connecting components of the present invention to form the water gun amusement device as a whole, unless specifically described otherwise, such are intended to encompass conventional fasteners such as screws, nut and bolt connectors, threaded connectors, snap rings, detent arrangements, clamps such as screw clamps and the like, rivets, toggles, pins and the like. Components may also be connected by adhesives, glues, welding, ultrasonic welding, and friction fitting or deformation, if appropriate, and appropriate liquid and/or airtight seals or sealing devices may be used. Electronic portions of the device may use conventional, commercially available electronic components, connectors and devices such as suitable wiring, connectors, printed circuit boards, microchips, speakers, lights, LED's, liquid crystal displays, pressure sensors, liquid level sensors, audio components, inputs, outputs and the like. Unless specifically otherwise disclosed or taught, materials for making components of the present invention may be selected from appropriate materials such as metal, metallic alloys, natural and man-made fibers, vinyls, plastics and the like, and appropriate manufacturing or production methods including casting, pressing, extruding, molding and machining may be used.

With regard to the manner in which water is urged to flow toward a discharge opening upon depression of a trigger or other means, it should be borne in mind that although the various embodiments described herein incorporate an on-board pump for pressurizing a water-containing, fixed-volume chamber with air, the invention is not limited to such configurations. For example, if the delivery of intermittent pulses are desired, a motorized arrangement as, for example, the one described in the aforementioned U.S. Pat. No. 4,022,350 may be used. By way of further example, the water storing chamber may be configured as an expandable bladder dimensioned and arranged to receive and store water from a hose end adapter coupled to a municipally pressurized water source (as in the case of the aforementioned U.S. Pat. Nos. 4,854,480 and 4,735,239 to Shindo and Salmon et al, respectively). By way of still further example, a water gun constructed in accordance with the teachings of the present invention may utilize both a bladder for storing pressurized water and an on-board, manually operated, fluid transfer pump for transferring fluid from an unpressurized water chamber having a fill cap to the bladder. An example of the latter arrangement is disclosed in U.S. Pat. No. 5,875,927 entitled TOY GUN HAVING AN EXPANDABLE TEAR DROP SHAPED BLADDER FOR EJECTION OF LIQUID THEREFROM. It suffices to say that the manner in which water ejection forces are developed is of no particular consequence to the inventor herein except insofar as manufacturing cost, simplicity and ease of use are always considerations to be borne in mind.

Turning now to FIGS. 1-4, in which like elements are denoted by like reference numerals, a first illustrative embodiment of a toy water gun amusement device 10 in accordance with the present invention is depicted. The depicted embodiment includes a generally gun-shaped (e.g., pistol, rifle or the like) body 12 having a handle portion 14 and a barrel portion 16. The device 10 includes a suitable trigger mechanism assembly 18 for actuating the gun, and a nozzle assembly 20 for emitting a stream of liquid.

As best seen in FIG. 1, device 10 further includes a water or liquid receiving and/or containing pressurization tank or chamber 24 defining a threaded fill opening 25 and having a threaded fill cap 26. Device 10 also includes a conduit 21 defining a discharge opening 23 adapted to establish fluid communication between chamber 24 and nozzle assembly 20. A fluid transfer system generally indicated at 22 is adapted to develop forces for causing a stream of liquid to flow through conduit 23 and out of the discharge orifice upon actuation of trigger mechanism 18. In the illustrative embodiment depicted in FIG. 1, fluid transfer system consists of a conventional, manually operated pump adapted to pressurize the contents of chamber 24 with air. An exemplary type of pump which may be used is shown and described in U.S. Pat. No. 6,474,507 issued on Nov. 5, 2002 to Hornsby et al., the disclosure of the same being expressly incorporated herein in its entirety. The Hornsby et al. structure depicted in the embodiment of FIG. 1 is especially advantageous in that it is a double acting mechanism—pressurized air is delivered into chamber 24 is delivered whether pump handle portion 22*a* is moved in the forward or rearward direction. Alternatively, fluid transfer system 22 may be configured as a motorized pump operative to pressurize chamber 24 with air or to supply intermittent pulses of water to discharge opening 23. By way of still further example, a water gun constructed in accordance with the present invention may incorporate a manual liquid transfer pump utilizing a rotating crank that includes a graspable handle. Such water guns, although they lack a trigger mechanism and require the user to continually rotate the crank during use, have enjoyed considerable success in the market. As the crank is rotated, the manual liquid transfer pump causes liquid to be withdrawn from a chamber, as chamber 24, and forces this liquid to exit a nozzle opening at the forward end of the gun. It suffices to say that various pumping arrangements are suitable so long as suitable forces can be developed to initiate and/or sustain the flow of liquid to nozzle assembly 20 for the desired interval of time.

As noted earlier, some embodiments of the present invention may have more than one chamber (not shown), in which case one such chamber may be a water-receiving, fixed volume fill chamber as chamber 24, and the other chamber may be a water-pressurizable bladder (not shown) or a fixed-volume, air-pressurizable, chamber (not shown) adapted to receive both water from the fill chamber and pressurized air. Thus, by way of yet another example, fluid transfer system 22 may be configured as a manually operable, water transfer pump (not shown) adapted to transfer water from a first, fixed volume chamber into a second, expandable bladder-type chamber. In the embodiment depicted in FIG. 1, removable fill cap 26 includes a one-way valve 27 and is dimensioned and arranged to receive a hose end, quick-fill fitting adapter (not shown) so that water under pressure may be directed into chamber 24, according to the teachings of the aforementioned U.S. Pat. No. 6,234,347. When a source of municipally pressurized water is not available, fill cap 26 is removed and water is poured directly into the chamber. Extending from within chamber 24 is a conventional purge valve assembly 29. The function of the purge valve assembly 29 is to relieve excess pressure by venting pressurized air and/or water when the pressure exceeds a selected point.

With continued reference to FIG. 1, it will be seen that the body 12 of amusement device 10 is generally hollow and is adapted to support and/or contain trigger mechanism 18, nozzle assembly 20 and fluid transfer system 22. Additionally, body 12 provides a housing for other conventional operational components, including liquid-conducting conduits and chambers, as chamber 24, for containing a liquid such as water. The illustrative embodiment of the present invention depicted in FIG. 1 employs a trigger and valve assembly 18 of the type shown and described in the aforementioned U.S. Pat. No. 6,474,507. The trigger assembly 18 constitutes a generally water or liquid tight valve or flow control mechanism or structure operable to actuate and control a stream or "shot" of water. In addition to a valve assembly disposed within the liquid flow path defined by conduit 21, trigger mechanism assembly 18 includes a trigger 18*a*, a trigger linkage assembly consisting of pivotable linkage members 18*b* and 18*c*, and a spring 18*d* for resiliently biasing linkage member 18*c* (and thereby linkage member 18*b* and trigger 18*a*) into an initial position of rest. As trigger 18*a* is depressed, linkage member 18*b* is pulled rearwardly, urging linkage member 18*c* against valve pin 18*e*. This movement unseats the valve body and causes pressurized water stored within chamber 24 to flow into and through conduit 21 toward rotatable nozzle assembly 20.

It will be recalled that nozzle assembly 22 is dimensioned and arranged to rotate so that while trigger 18*a* is depressed, the stream of water being discharged through discharge outlet 32 defined by the element indicated generally at element 34, traverses an arcuate path relative to the longitudinal axis of the barrel portion while the barrel portion remains stationary. The stream thus discharged has a helical configuration, which is unbroken for so long as the trigger is depressed and water is flowing through conduit 21.

Automatic rotation of nozzle assembly 20 to produce a helical discharge effect can be achieved in a variety of ways.

By way of illustrative example, an illustrative nozzle assembly constructed in accordance with this embodiment of the invention may include a motorized drive assembly (not shown) responsive to depression of the trigger or, alternatively, to actuation of an on/off selector switch, and drivingly engageable with appropriate gearing coupled to nozzle assembly 20. By way of alternate example, discharge outlet 32 of nozzle assembly 20 may be dimensioned and arranged to impart a nozzle reaction force—that is offset relative to the axis of nozzle assembly rotation—as the stream of water is discharged. Even a relatively small angle of inclination of the discharge stream relative to a plane orthogonal to the rotational axis of the nozzle assembly is sufficient to induce rotation of the nozzle assembly. It should also be noted that triggerless structures are also contemplated by the inventor herein. For example, in a water gun employing a manually rotated crank to operate a liquid transfer pump, the rotating crank shaft can also be used to drive appropriate gearing for rotating nozzle assembly 20 at the same time. Other forms of triggerless operation contemplated include a voice actuation circuit responsive to speech signals, input by microphone, to operate a solenoid valve or other suitable structure disposed along the fluid communication path defined by conduit 21.

Figure 2:
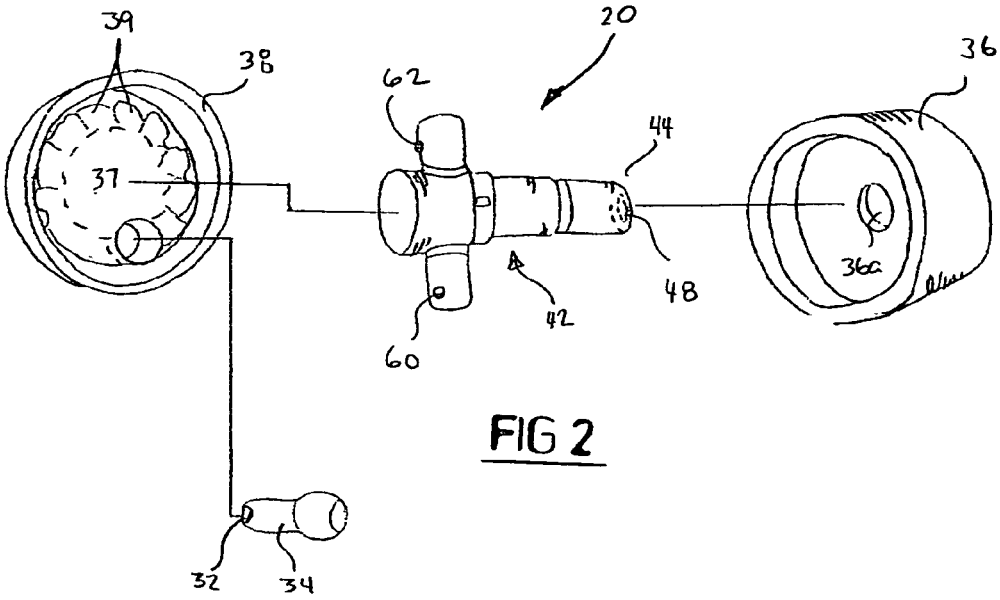
FIG. 2 is broken apart, perspective view depicting the internal construction of an exemplary, rotating nozzle assembly for use in realizing the illustrative embodiment of FIG. 1.
Figure 3:
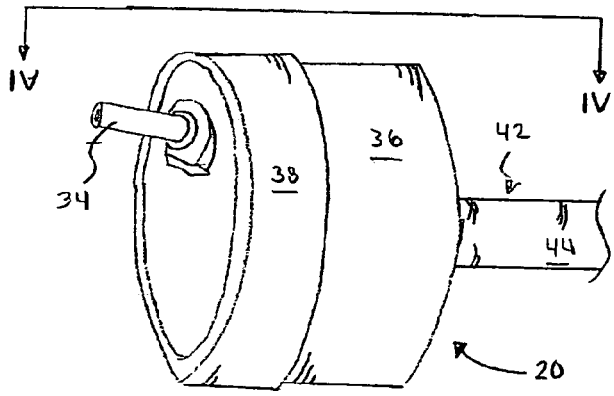
FIG. 3 is a perspective view depicting final assembly of the exemplary rotating nozzle assembly of FIG. 2.
Figure 4:
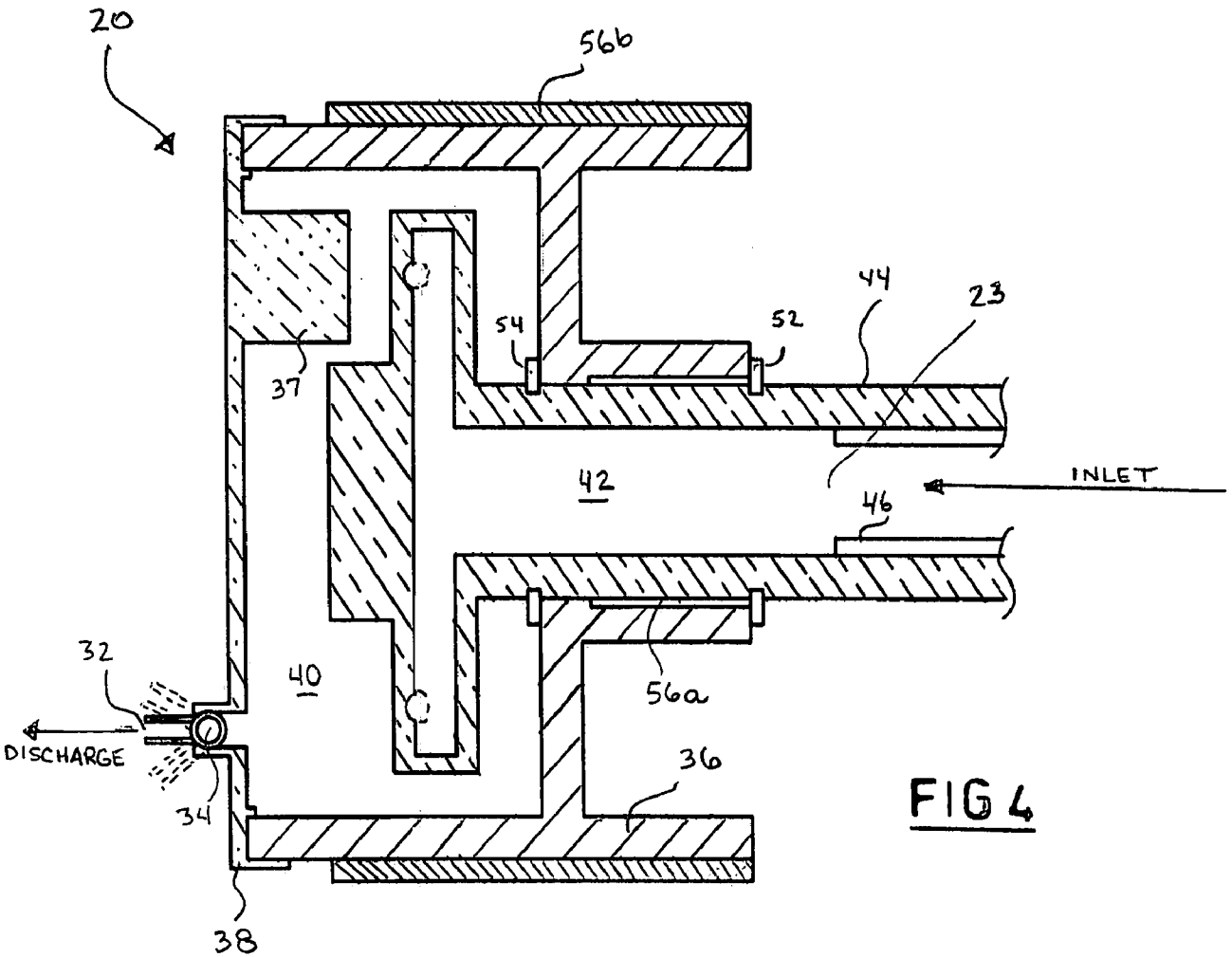
FIG. 4 is a cross sectional view of the exemplary rotating nozzle assembly of FIGS. 2 and 3, taken across the plane IV-IV depicted in FIG. 3.

In accordance with an especially preferred embodiment of the present invention, however, the force for spinning nozzle assembly 20 is provided via the pressurized water stream traversing conduit 21. An exemplary structure adapted to utilize this force is depicted in FIGS. 2-4 and will now be described in detail. As seen in FIGS. 2, nozzle assembly 20 comprises a first section 36 and a second section 38 which, when assembled into the configuration shown in FIGS. 3 and 4, define an interior cavity 40 (FIG. 4) within which is disposed a flow diverter assembly indicated generally at 42.

With reference to both FIGS. 2 and 4, it will be seen that flow diverter assembly 42 has a proximal end 44 dimensioned and arranged to receive and retain the distal end 46 of conduit 21. Conduit 21 and flow diverter assembly 42 are fastened together in a conventional manner such, for example, as by a suitable adhesive. As such, fluid diverter assembly 42 is not a moving part but, rather, is stationary despite being disposed within interior cavity 40. Fluid exiting the discharge orifice 23 of conduit 21 enters an inlet 48 defined at the proximal end 44 of flow diverter assembly 42. The center of first section 36 defines an axial opening through which proximal end 44 is inserted. Locking rings indicated generally at 52 and 54 in FIG. 4 prevent axial movement of diverter assembly 42 relative to first section 38. A first bushing indicated generally at 56*a* enables first section to rotate about an axis defined by flow diverter assembly 42. To prevent water from leaking out of interior cavity 40 , O-rings or other suitable gaskets may be utilized at the interface between the interior surface of bore 36*a* of first section 36 and the exterior surface of diverter assembly 42. A second bushing, indicated generally at 56*b* is provided to retain and support nozzle assembly 20 within body 12 of water gun 10 while still allowing it to freely rotate.

Defined within the interior axial surface 37 of second section 38 are a plurality of vanes 39. As best seen in FIG. 2, liquid entering inlet opening 48 of flow diverter assembly 42 exits via a pair of exit openings indicated generally at 60 and 62. As will be readily appreciated by those skilled in the art, exit opening 60 and 62 are dimensioned and arranged so as to cause corresponding jets of liquid to impinge upon the surfaces of vanes 39, thereby initiating rotation of first section 36 and second section 38.

In the illustrative embodiment depicted in FIGS. 1-4, it will be seen that water exits the spinning nozzle assembly 20 via a pivotably movable nozzle member 34. Such a structure is advantageous in that it gives the user a high degree of flexibility in defining the diameter and/or pitch of the helical stream which is discharged. Of course, if such flexibility is not a design constraint, then it is of course possible to integrally form a nozzle member directly as part of second section 38. In that regard, it is contemplated that a nozzle member so constructed may be configured to extend forward at any desired angle relative to the axis of rotation of rotatable nozzle assembly 20. It is further contemplated that multiple nozzle members may be included so as to cause to simultaneous streams to be helically wound about the axis of nozzle assembly rotation.

Figure 5:
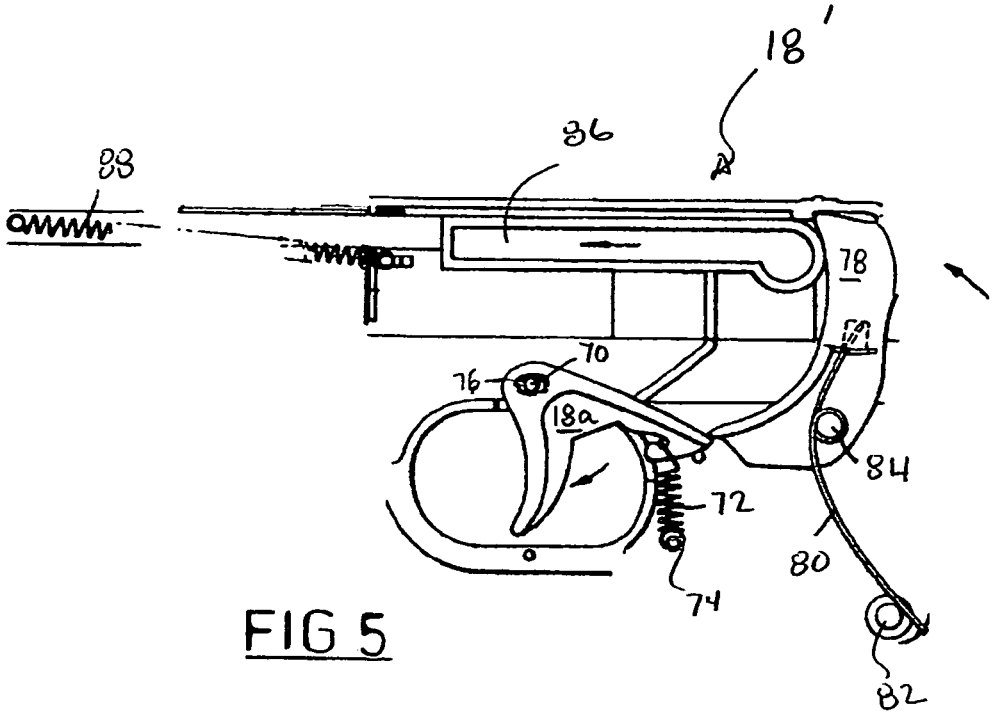
FIGS. 5 and 6 are respective side elevation views of an alternate trigger assembly manipulable into a first operative position wherein a continuous flow through the nozzle assembly is initiated and maintained and into a second or "pulsing" position wherein only a brief (on the order of several seconds or so) discharge through the nozzle assembly is sustained.
Figure 6:
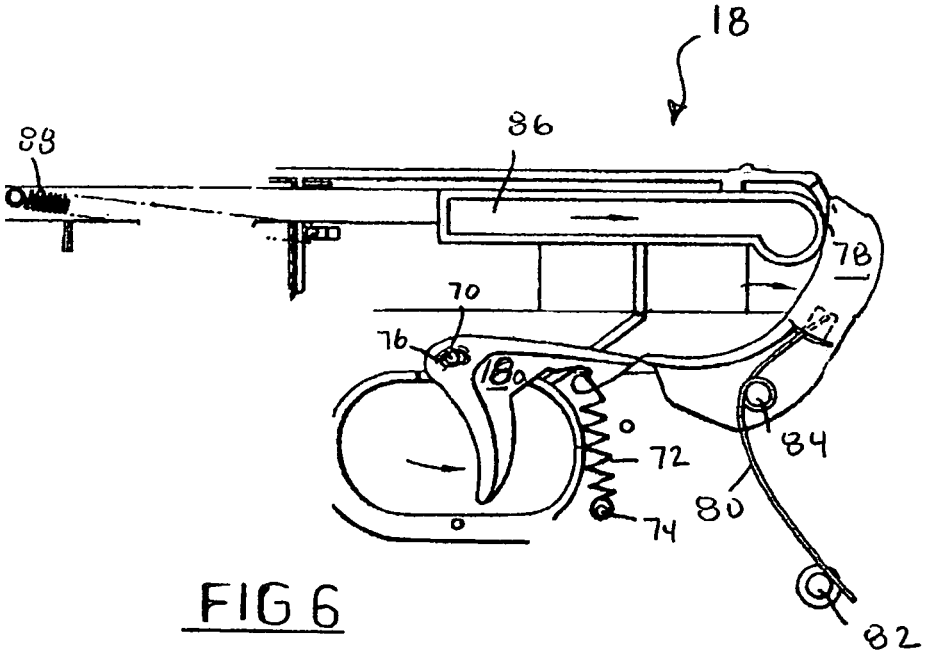

Turning now to FIGS. 5 and 6, there is disclosed an alternate trigger mechanism 18' operative in a first mode, during which liquid flows continuously from spinning nozzle assembly 20 for so long as trigger 18*a*' is maintained in a first position and in a second mode, in which a short burst of liquid flows when the trigger is depressed into a second position, to thereby form a truncated helical stream reminiscent of a tornado. The trigger mechanism described herein is suitable for use with any of the embodiments disclosed and/or described in detail herein. It should be noted, however, that the valve structures employed in the various depicted embodiments (including the embodiment of FIGS. 1-4) rely upon rearward motion of the valve pin and body as the trigger is depressed, and the trigger mechanism of FIGS. 5 and 6 are also designed to produce rearward motion of the valve pin and body as the trigger is depressed. To the extent a forward motion of the valve pin and body are needed, it is believed by the inventor herein that the rearrangement of parts within the fluid communication path so as to reverse the direction of valve movement is well within the level of skill of the ordinary artisan.

Pivotable trigger member 18*a*' is mounted on a lug 70 and is resiliently urged forward by a return spring 72 attached to trigger member 18*a*' and to a second lug 74. It will be noted that mounting aperture 76 in the trigger member 18*a*' is elongate so as to permit the longitudinal movement of trigger member 18*a*' to recock the trigger. Acting on by the trigger member 18*a*' is a pivotable camming member 78 resiliently urged in the anticlockwise direction by a strong spring 80 engaged over lug 82 and with camming member 78 and also with lug 84. It will be seen that when trigger 18*a*' is pulled, it engages with camming member 78 and urges it in a clockwise direction against the force of spring 80 until toward the end of its travel trigger member 18*a*' slips off the end of camming member 78 which thereupon rapidly returns to its original position under spring action.

Associated with camming member 78 is a longitudinally movable slide member 86 mounted for linear movement to thereby provide the motive force for urging a valve disposed along the fluid communication path defined by conduit 24 into an open position permitting flow. A spring 88 connected between the end of slide member 86 and the housing draws slide member 86 back when camming member 78 is drawn back. In FIG. 6, camming member 78 is in a first position, corresponding to a "continuous stream mode of operation" during which the valve assembly (not shown) connected to movable slide member 86 is open. For a "pulsed stream mode of operation", the trigger mechanism is squeezed quickly, such that camming member 78 is, in a very brief time, released from its engagement with sliding member 86—rapidly urging slide member 86 (and the valve assembly to which it is linked) back quickly into the off position.

Figure 7:
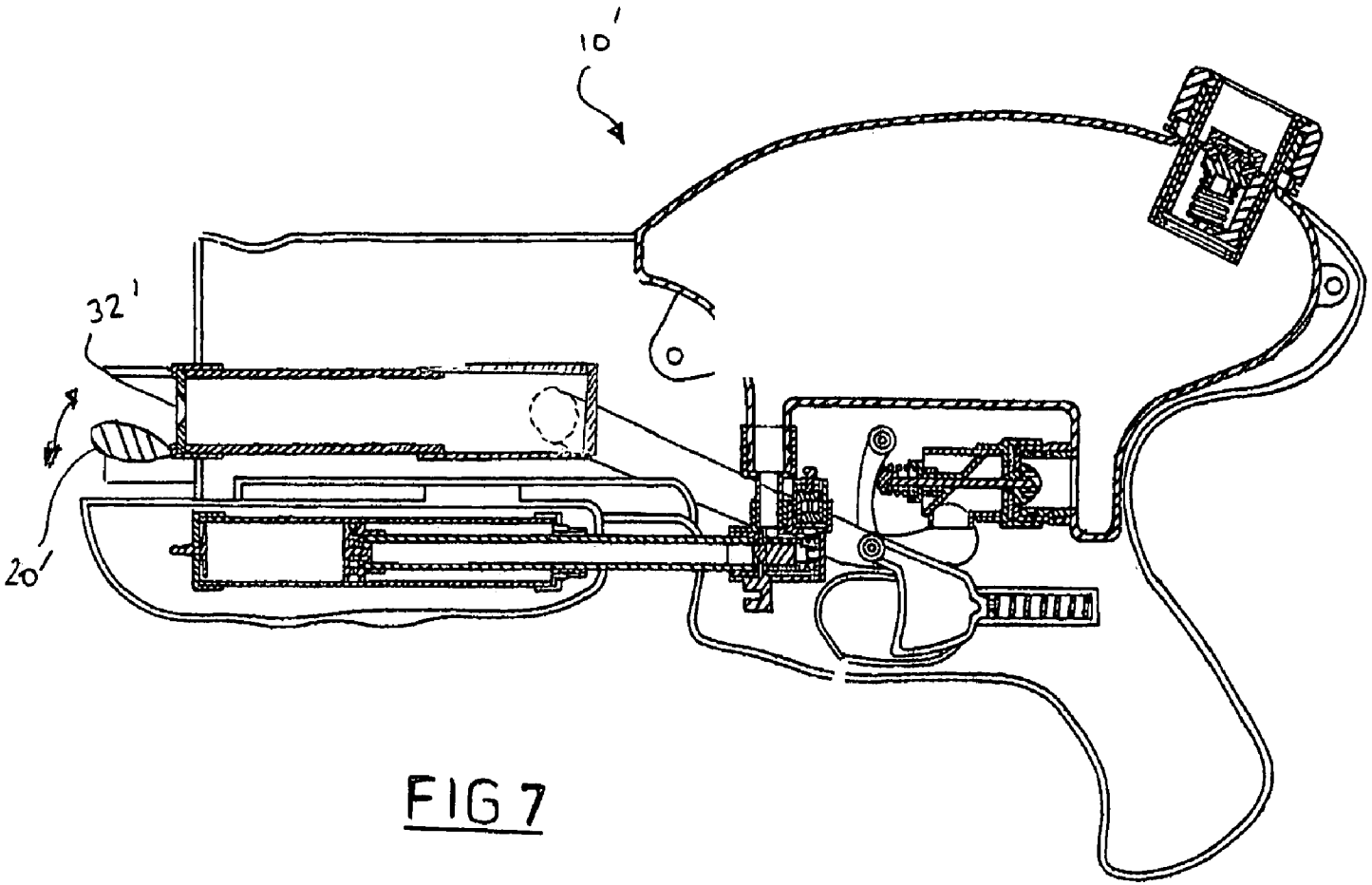
FIG. 7 is a side elevation view, in cross section, depicting a water gun constructed in accordance with a second illustrative embodiment of the present invention, the water gun being equipped with a deflector structure aligned or alignable with the discharge orifice and dimensioned and arranged to cause a continuous or pulsed stream incident thereon to spread into a flattened, "wave-like" configuration.
Figure 8:
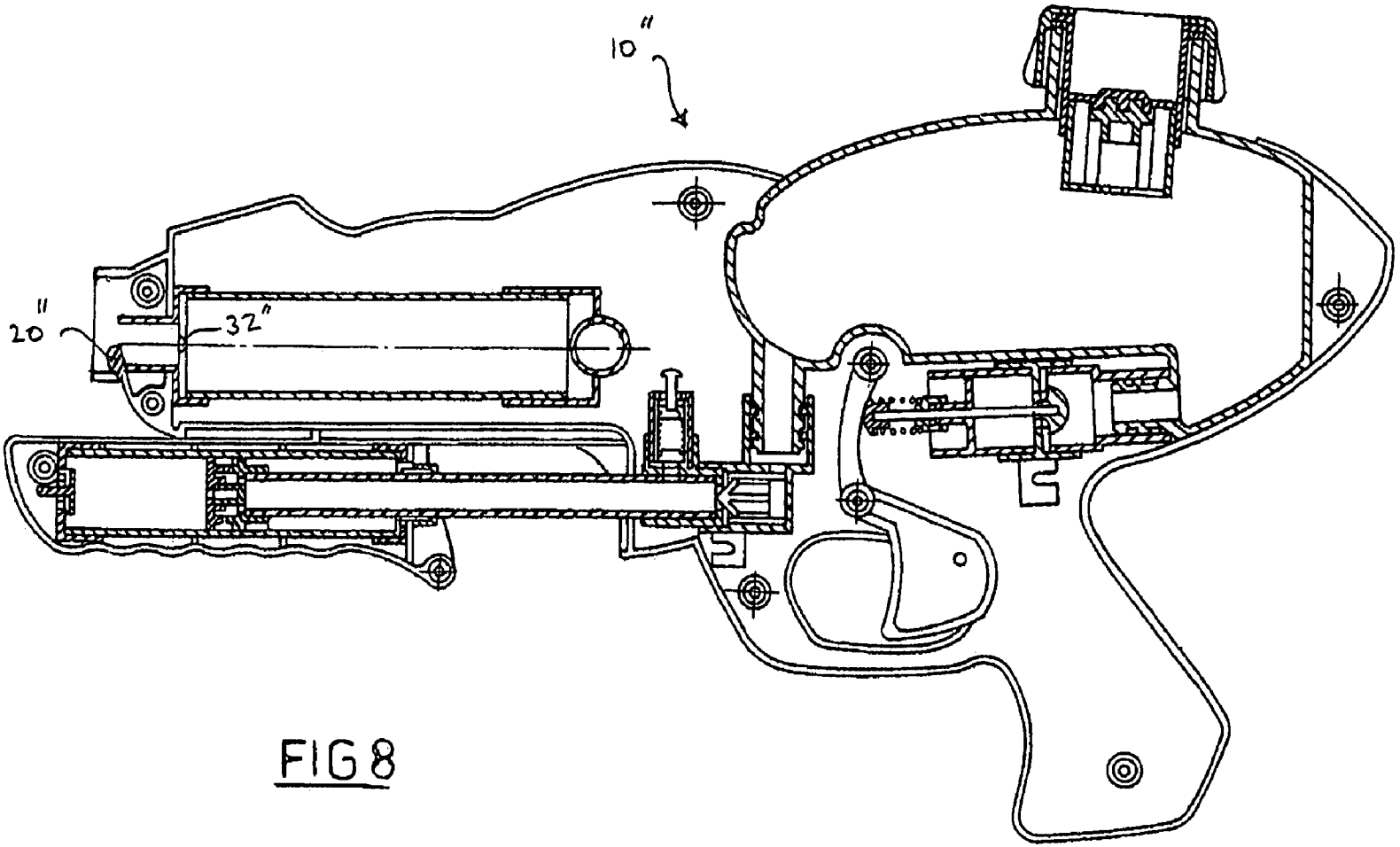
FIG. 8 is a side elevation view, in cross section, depicting a water gun constructed in accordance with a third illustrative embodiment of the present invention, the water gun being equipped with a deflector structure aligned or alignable with the discharge orifice and dimensioned and arranged to cause a continuous or pulsed stream incident thereon to diffuse in a manner which simulates a "hard rain" effect.

FIGS. 7 and 8 depict alternate embodiments of the present invention in which other "weather-associated" liquid discharges are achieved. Whereas the embodiment of FIGS. 1-4 may be characterized as approximating a "cyclone" or "twister" discharge configuration, the embodiment of FIG. 7 is intended to achieve a "wave" configuration. To that end, the toy water gun 10'—which is essentially a conventional toy water gun in every respect—incorporate a pivotable deflector element aligned with the nozzle opening 32' such that a pulsed or continuous stream ejected by the water gun impinges upon a surface of the deflector element. The surface is dimensioned and arranged so as to cause the stream to change its cross sectional profile from a substantially circular cross section to a flattened wall of water resembling a "wave". To accommodate a second, conventional "straight stream" mode of operation, the pivotable deflector element may be moved out of the path of the ejected stream.

FIG. 8 is intended to achieve a "hard rain" configuration and, like the embodiment of FIG. 7, relies upon a deflector element 20" aligned with the nozzle opening 32". In contrast to the embodiment of FIG. 7, however, the deflector element 20" of the embodiment of FIG. 8 is affixed to the housing and is not movable relative to the nozzle opening. Other configurations for achieving a hard rain effect are contemplated by the inventor. By way of illustration, a water gun constructed in accordance with the invention may include a trigger, a latching mechanism, and a spring loaded, pivoting catapult lever defining a receptacle that is dimensioned and arranged to receive a charge of water and to hurl this charge of water at a target when the trigger is depressed and the latching mechanism is released. The spring-loaded, pivoting receptacle is positioned within the barrel portion of the housing and is charged with water while in an initial position. When released by the latching mechanism, the receptacle pivots about an axis transverse to the longitudinal axis of the barrel and the charge of water is released once the catapult lever reaches a certain point in its arcuate travel. A cover assembly utilizing a spring actuated linkage or other suitable mechanism can be included so that the water can not escape from the receptacle during pivoting of the catapult lever.

While the particular water guns as herein shown and described in detail are fully capable of attaining the above-described objects of the invention, it is to be understood that they are merely illustrative embodiments of the present invention and are thus merely representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A toy water gun, comprising:

a housing having a front end and a rear end;

a chamber supported by said housing for containing a liquid;

a conduit for establishing fluid communication between said chamber and a discharge orifice disposed proximate a front end of said housing;

a trigger mechanism comprising a trigger and at least one resilient spring;

a fluid transfer system operative to develop forces for causing a stream of liquid to flow through said conduit and out of said discharge orifice upon actuation of said trigger mechanism; and a rotatable nozzle assembly dimensioned and arranged to spin in a single direction about an axis of rotation while receiving a stream of liquid via the discharge orifice, said rotatable nozzle assembly having a cup-shaped portion formed by an end wall and a circumferential wall of said nozzle assembly, said end wall and said circumferential wall of said cup-shaped portion forming sides of an interior cavity in fluid communication with said discharge orifice such that fluid exiting said discharge orifice enters and fills said interior cavity, a nozzle through-hole is disposed in said bottom wall in communication with said interior cavity and offset from said axis of rotation, wherein said nozzle assembly ejects the stream of liquid from said interior cavity through said through-hole as said nozzle assembly ejects the stream of liquid from said interior cavity through said through-hole as said nozzle assembly spins to thereby obtain a helical flow pattern when said housing is held steady, said nozzle assembly being driven to rotate in said single direction by one of a motorized drive assembly and energy imparted by moving liquid;

wherein said nozzle assembly further includes a pivotably movable nozzle member offset from the axis of rotation, said nozzle member having a distal section defining a nozzle orifice and a substantially spherical proximal section retained in fluid communication with said through-hole, whereby a user can adjust at least one of a diameter and a pitch of said helical flow pattern.

2. The toy water gun of claim 1, wherein said nozzle assembly further includes a plurality of vanes disposed within said interior cavity, said vanes being dimensioned and arranged to convert energy imparted by liquid impinging thereon into forces driving rotary motion of said nozzle assembly.

3. The toy water gun of claim 1, wherein said nozzle assembly further includes a nozzle member in fluid communication with said discharge orifice and offset from said axis of rotation.

4. The toy water gun of claim 3, wherein said nozzle member is pivotably movable so that a user can adjust a pitch of said helical flow pattern.

5. The toy water gun of claim 1, wherein said fluid transfer system comprises a manually operable pump configured to pressurize said chamber.

6. The toy water gun of claim 1, wherein said chamber defines a threaded fill opening, said toy water gun further comprising a threaded fill cap adapted for mating engagement with the chamber and defining a one-way valve for allowing a pressurized fluid to enter said chamber.

7. The toy water gun of claim 1, wherein said water gun is operative in a second mode in which said rotatable nozzle assembly remains stationary while liquid is ejected therefrom.

8. The toy water gun of claim 1, wherein said trigger mechanism is operative in a first mode, in which liquid flows continuously from said rotatable nozzle assembly for so long as said trigger is maintained in a first position and in a second mode, in which a short burst of liquid flows when the trigger is depressed into a second position.

9. The toy water gun of claim 1, wherein said nozzle assembly further includes a flow director assembly adapted to receive liquid arriving via the discharge orifice and to change a direction of flow so as to cause arriving liquid to impinge upon said vanes.

10. The toy water gun of claim 1, wherein said chamber defines a threaded fill opening, said toy water gun further comprising a threaded fill cap adapted for mating engagement with the chamber and defining a one-way valve for allowing a pressurized fluid to enter said chamber.

11. The toy water gun of claim 1, wherein said water gun is operative in a second mode in which said rotatable nozzle assembly remains stationary while liquid is ejected therefrom.

12. A toy water gun, comprising:

a housing having a front end and a rear end;

a chamber supported by said housing for containing a liquid;

a conduit for establishing fluid communication between said chamber and a discharge orifice disposed proximate a front end of said housing;

a trigger mechanism comprising a trigger and at least one resilient spring;

a fluid transfer system operative to develop forces for causing a stream of liquid to flow through said conduit and out of said discharge orifice upon actuation of said trigger mechanism; and a rotatable nozzle assembly dimensioned and arranged to spin in a single direction about an axis of rotation while receiving a stream of liquid via the discharge orifice stream of liquid as it spins to thereby obtain a helical flow pattern, said nozzle assembly being driven to rotate in said single direction by one of a motorized drive assembly and energy imparted by moving liquid, wherein said nozzle assembly includes a first section defining an interior cavity, said first section further defining an inlet opening dimensioned and arranged to establish fluid communication between the interior cavity and said conduit discharge orifice, and an outlet opening dimensioned and arranged to allow fluid under pressure to exit said interior cavity as a stream as said first section spins, wherein said nozzle assembly further includes a pivotably movable nozzle member offset from the axis of rotation, said nozzle member having a nozzle orifice and a substantially spherical insert portion pivotably retained in said outlet opening, wherein a pivotable position of said nozzle member is controlled to produce a desired diameter and a desired pitch of said helical flow pattern.

13. The toy water gun of claim 12, wherein said nozzle assembly further includes a flow director assembly adapted to receive liquid arriving via the discharge orifice and to change the direction of flow so as to cause arriving liquid to impinge upon said vanes.

14. A toy water gun, comprising:

a housing having a front end and a rear end;

a chamber supported by said housing for containing a liquid;

a discharge orifice in fluid communication with said chamber;

a trigger mechanism;

a fluid pressurizing assembly dimensioned and arranged to force a stream of liquid out of the discharge orifice upon actuation of said trigger mechanism; and a rotatable nozzle assembly dimensioned and arranged to spin about an axis of rotation while receiving a stream of liquid via the discharge orifice and to eject a stream of liquid as it spins to obtain a helical flow pattern when the housing is held steady, said rotatable nozzle assembly having a cup-shaped portion formed by an end wall and a circumferential wall of said nozzle assembly, said end wall and said circumferential wall of said cup-shaped portion forming sides of an interior cavity in communication with said discharge orifice such that liquid exiting said discharge orifice enters and fills said interior cavity, said nozzle assembly being driven to rotate by one of a motorized drive assembly and energy imparted by moving liquid, and said nozzle assembly including a nozzle through-hole in said end wall in fluid communication with said interior cavity and offset from said axis of rotation, wherein the ejected stream of liquid passes through said through-hole when the nozzle assembly spins to thereby obtain the helical flow pattern.

15. The toy water gun of claim 14, further including a water turbine assembly for rotating said nozzle assembly in a single direction about said axis of rotation.

16. The toy water gun of claim 14, further including a motorized drive assembly for rotating said nozzle assembly about said axis of rotation.

17. A toy water gun, comprising:

a housing having a front end and a rear end;

a chamber supported by said housing for containing a liquid;

a conduit for establishing fluid communication between said chamber and a discharge orifice disposed proximate a front end of said housing;

a trigger mechanism comprising a trigger and at least one resilient spring;

a fluid transfer system operative to develop forces for causing a stream of liquid to flow through said conduit and out of said discharge orifice upon actuation of said trigger mechanism; and a rotatable nozzle assembly dimensioned and arranged to spin in a single direction about an axis of rotation while receiving a stream of liquid via the discharge orifice stream of liquid as it spins to thereby obtain a helical flow pattern, said nozzle assembly being driven to rotate in said single direction by one of a motorized drive assembly and energy imparted by moving liquid, wherein said nozzle assembly includes a first section having walls forming sides of an interior cavity in the first section, said first section further defining an inlet opening dimensioned and arranged to establish fluid communication between the interior cavity and said conduit discharge orifice, and an outlet opening dimensioned and arranged to allow fluid under pressure to exit said interior cavity as a stream as said first section spins, wherein said nozzle assembly further includes a plurality of vanes disposed within said-interior cavity, said vanes being dimensioned and arranged to convert energy imparted by liquid impinging thereon into forces driving rotary motion of said first section, and wherein said nozzle assembly further includes a flow director assembly adapted to receive liquid arriving via the discharge orifice and to change a direction of flow so as to cause arriving liquid to impinge upon said vanes.

18. A toy water gun, comprising:

a housing having a front end and a rear end;

a chamber supported by said housing for containing a liquid;

a conduit for establishing fluid communication between said chamber and a discharge orifice disposed proximate a front end of said housing;

a trigger mechanism comprising a trigger and at least one resilient spring;

a fluid transfer system operative to develop forces for causing a stream of liquid to flow through said conduit and out of said discharge orifice upon actuation of said trigger mechanism; and a rotatable nozzle assembly dimensioned and arranged to spin in a single direction about an axis of rotation while receiving a stream of liquid via the discharge orifice stream of liquid as it spins to thereby obtain a helical flow pattern, said nozzle assembly being driven to rotate in said single direction by one of a motorized drive assembly and energy imparted by moving liquid, wherein said nozzle assembly includes a first section having walls forming sides of an interior cavity in the first section, said first section further defining an inlet opening dimensioned and arranged to establish fluid communication between the interior cavity and said conduit discharge orifice, and an outlet opening dimensioned and arranged to allow fluid under pressure to exit said interior cavity as a stream as said first section spins, wherein said nozzle assembly further includes a plurality of vanes disposed within said-interior cavity, said vanes being dimensioned and arranged to convert energy imparted by liquid impinging thereon into forces driving rotary motion of said first section, and wherein said nozzle assembly further includes a pivotably movable nozzle member offset from the axis of rotation, said nozzle member having a nozzle orifice and a substantially spherical insert portion pivotably retained in said outlet opening, wherein a pivotable position of said nozzle member is controlled to produce a diameter and a pitch of said helical flow pattern.

* * * * *